United States Patent [19]

Meyer

[11] Patent Number: 4,530,782

[45] Date of Patent: Jul. 23, 1985

[54] ELECTRICAL APPARATUS HAVING AN IMPROVED LIQUID DIELECTRIC COMPOSITION

[75] Inventor: William R. Meyer, Cassville, Wis.

[73] Assignee: McGraw-Edison Company, Elgin, Ill.

[21] Appl. No.: 576,157

[22] Filed: Feb. 2, 1984 (Under 37 CFR 1.47)

Related U.S. Application Data

[63] Continuation-in-part of Ser. No. 428,964, Sep. 30, 1982, abandoned, which is a continuation of Ser. No. 247,530, Mar. 25, 1981, abandoned.

[51] Int. Cl.[3] ..... H01B 3/22

[52] U.S. Cl. ..... 252/578; 585/6.6

[58] Field of Search ..... 585/6.6; 252/578; 174/17 LF

[56] References Cited

U.S. PATENT DOCUMENTS 3,436,349 4/1969 Olund ..... 585/6.6

4,211,665 7/1980 Pellegrini ..... 252/578 X

FOREIGN PATENT DOCUMENTS 5008 10/1979 European Pat. Off. ..... 585/6.6

*Primary Examiner*—John D. Welsh

*Attorney, Agent, or Firm*—Andrus, Sceales, Starke & Sawall

[57] ABSTRACT

A dielectric liquid composition for use in an electrical apparatus, such as a transformer. The dielectric composition is composed of 10% to 90% by weight of one or more hydrocarbon oils having a molecular weight distribution peak in the range of 460 to 720, and the balance being a polyalphaolefin having a molecular weight distribution peak of 320 to 600. The dielectric liquid composition has a fire point above 300° C., a pour point at least as low as −20° C., and is thermally stable and essentially biodegradable.

7 Claims, 3 Drawing Figures

ELECTRICAL APPARATUS HAVING AN IMPROVED LIQUID DIELECTRIC COMPOSITION

RELATED APPLICATION

This application is a continuation-in-part of application Ser. No. 06/428,964, filed Sept. 30, 1982, now abandoned which in turn is a continuation of application Ser. No. 06/247,530, filed Mar. 25, 1981, now abandoned.

BACKGROUND OF THE INVENTION

In the past, polychlorinated biphenyls have been widely used as dielectric liquids in electrical equipment. The polychlorinated biphenyls are particularly well suited in applications where fire hazards are a problem because of their relatively high fire point. While these materials produce an effective dielectric system for electrical equipment, their usage has provided certain ecological problems in that the polychlorinated biphenyls are virtually non-biodegradable, with the result that if leakage or rupture occurs in the electrical equipment, or if the equipment is discarded as obsolete, the polychlorinated biphenyls will remain as a pollutant in the environment and will not degrade to any appreciable extent, even over extended periods of years.

Recently, there has been increased activity in developing an inexpensive, biodegradable, thermally stable, high fire point dielectric fluid as a substitute for the polychlorinated biphenyls.

Attempts have been made to use polyalphaolefins as dielectric liquids, but they are relatively expensive and tend to oxidize over a period of time, resulting in the formation of acidic by-products which reduce the efficiency and life of the electrical apparatus. Thus, antioxidants are required with polyalphaolefins to reduce the effects of aging.

Mineral oils have also been suggested for use as dielectric liquids for transformers. However, high molecular weight hydrocarbon oils, which have fire points over 300° C. are not suitable as dielectrics because of their high pour points in the range of 0° C. to −10° C. Because of the high pour point, the high molecular weight oils cannot be used in electrical equipment which is exposed to low operating temperatures. On other other hand, low molecular weight hydrocarbon oils, which have lower pour points, are not suitable as dielectrics because they have relatively low fire points, well below 300° C.

SUMMARY OF THE INVENTION

The invention is directed to an improved high fire point dielectric liquid composition for use in an electrical apparatus, composed of a combination of fluids which in themselves are not suitable for use as a high fire point dielectric. The dielectric liquid had a wide operating temperature range, is thermally stable, and is essentially completely biodegradable.

In general, the dielectric liquid composition is composed of 10% to 90% by weight of one or more hydrocarbon oils having a molecular weight distribution such that its peak falls in the range of 460 to 720, and the balance being a polyalphaolefin with a molecular weight distribution such that its peak falls in the range of 320 to 600. The particular amounts of the components are selected so that the resulting dielectric liquid composition has a fire point above 300° C. and a pour point below −20° C. with a molecular weight distribution such that its peak falls between 530 and 620.

The novel dielectric composition of the invention takes advantage of the wide operating temperature range of the polyalphaolefins and the inherent oxidation stability of the hydrocarbon oils to produce an improved dielectric fluid suitable for use in various types of electrical equipment. In addition, the electrical aging characteristics of the composition of the invention are superior to those of the polyalphaolefin and due to the incorporation of the relatively inexpensive hydrocarbon oils, the cost of the composition is considerably less than that of the polyalphaolefin alone.

The liquid dielectric of the invention is catagorized as a high fire point dielectric, having particular application for indoor use. The liquid dielectric can be used in transformers, as well as other electrical apparatus, such as capacitors, cables, and circuit breakers.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
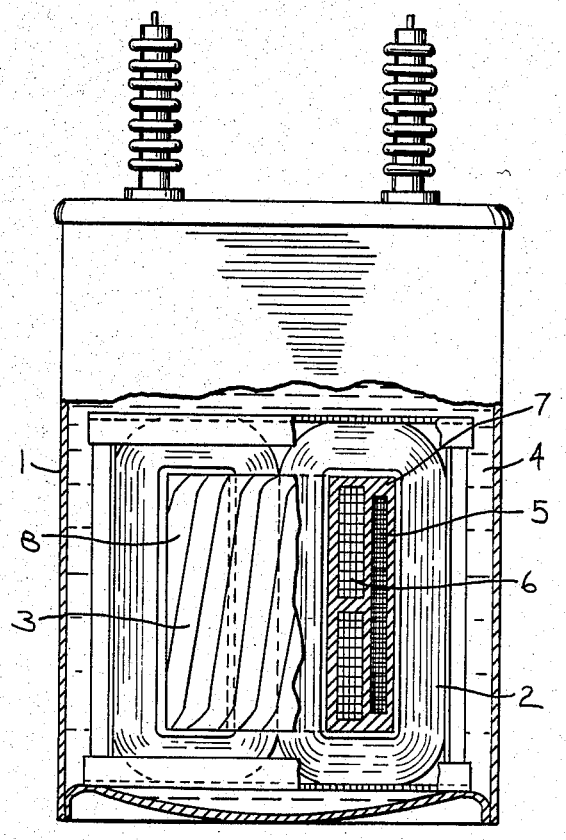
FIG. 1 is a side elevation with parts broken away of a typical transformer incorporating the dielectric liquid of the invention.
Figure 2:
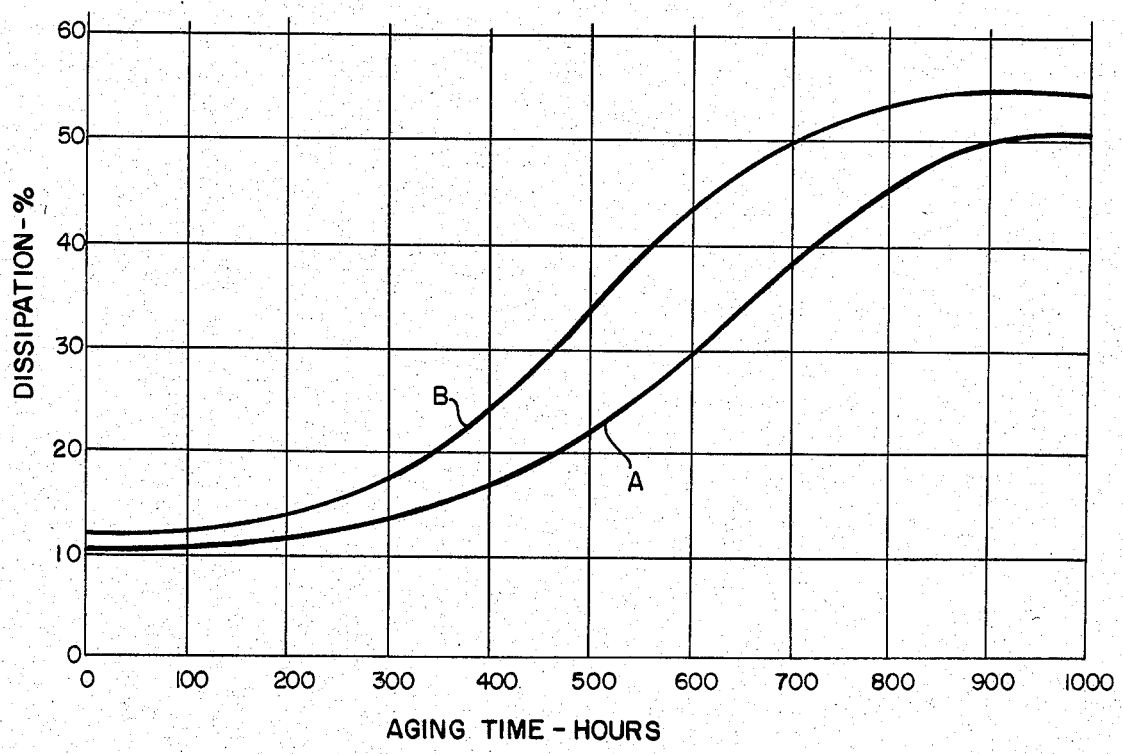
FIG. 2 is a curve plotting the dissipation factor against time on test of the dielectric composition of the invention as compared to 100% polyalphaolefin.
Figure 3:
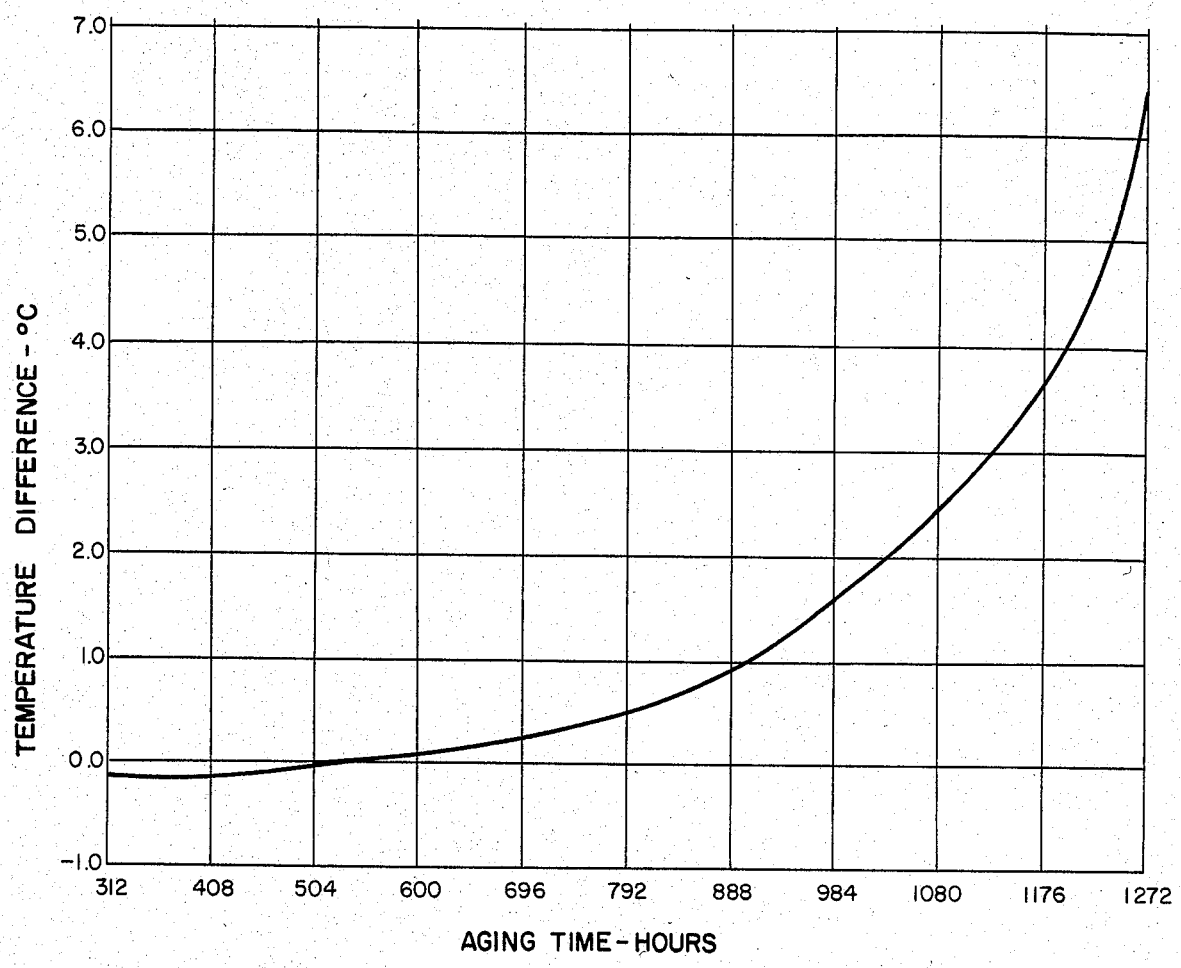
FIG. 3 is a curve showing the temperature differential in 10 KVA distribution transformers, one incorporating the dielectric composition of the invention and the second utilizing 100% polyalphaolefin as the liquid dielectric.

FIG. 1 illustrates a typical transformer, comprising a hermetically sealed tank or casing 1, enclosing a magnetic core 2 and coil 3 and being partially filled with the liquid dielectric composition 4 of the invention. Coil 3 comprises a high voltage winding 5 and low voltage winding 6 which are insulated from each other by treated cellulosic sheets 7, such as Kraft paper impregnated with a dicyandiamide. The coil 3 can also have an exterior cellulose wrapping 8.

In general, the dielectric liquid is composed of one or more hydrocarbon oils and a polyalphaolefin and has the following composition by weight:

| | |
|---|---|
| Hydrocarbon oil | 10% to 90% |
| Polyalphaolefin | balance |

Olefins in general have have the formula $C_nH_{2n}$, containing one double bond within the molecule. The alpha olefins contain the double bond in the C—1 position. The olefin group of the polyalphaolefin to be used in the invention contains 8 to 12 carbon atoms in the olefin monomer and has a molecular weight distribution such that its peak is in the range of 360 to 600 and preferably about, 530 to 580. The polyalphaolefin has a viscosity of about 3 to 15 centistokes at 100° C., a pour point in the range of about −40° C. to −75° C. and a fire point in the range of about 250° C. to 325° C.

The hydrocarbon oil has a molecular weight distribution peak in the range of 460 to 720, a fire point in the range of 260° C. to 355° C., a viscosity at 100° C. in the range of about 10 to 30 centistokes, a pour point of about 0° C. to −18° C., and a flash point of about 230° C. to 320° C.

Paraffinic based oils are preferred for the hydrocarbon oil due to their availability, but naphthenic based oils can also be employed. Prior to use, the oils can be cleaned with Fuller's Earth and then filtered through 2.0 to 0.5 micron filter paper.

In addition, small amounts up to 5% by weight of common polystyrene based pour point depressants, (such as Edwin Cooper high tech. E.−672 or Texaco—TC—10214) can be incorporated in the composition.

The manner of mixing the hydrocarbon oils and the polyalphaolefin is not critical and the liquids can be mixed together at room temperature with standard mixing equipment.

The particular amounts and physical properties of the hydrocarbon oils and the polyalphaolefin are selected, within the aforementioned ranges, so that after blending, the liquid dielectric composition has a fire point above 300° C., and generally in the range of 305° C. to 315° C., and a pour point of at least −20° C., and generally in the range of −20° C. to −30° C.

In a preferred form of the invention, the dielectric liquid has the following composition by weight.

| | |
|---|---|
| Low Molecular Weight Hydrocarbon | 1%–25% |
| High Molecular Weight Hydrocarbon | 40%–80% |
| Polyalphaolefin | balance |

The liquid dielectric has the following preferred range of composition by weight:

| | |
|---|---|
| Low Molecular Weight Hydrocarbon | 5%–15% |
| High molecular weight Hydrocarbon | 60%–70% |
| Polyalphaolefin | balance |

The high molecular weight hydrocarbon can take the form of hydrocarbon oils having a molecular weight distribution peak in the range of 600 to 720, a fire point in the range of 325° C. to 335° C., a viscosity at 100° C. in the range of 20 to 30 centistokes, a pour point of 0° C. to −10° C., and a flash point in the range of 295° C. to 320° C.

The low molecular weight hydrocarbon should have a molecular weight distribution peak in the range of 460 to 510, a fire point in the range of 260° C. to 280° C., a viscosity at 100° C. of 10 to 16 centistokes, a pour point in the range of −10° C. to −18° C., and a flash point of 230° C. to 250° C.

Specific examples illustrating the preparation of the dielectric liquid of the invention are as follows:

EXAMPLE I

A dielectric liquid composition was prepared by mixing 50% by weight of a high molecular weight, hydrocarbon oil, 30% by weight of a low molecular weight hydrocarbon oil, and 20% by weight of a polyalphaolefin. The physical properties of the components were as follows:

| HIGH MOLECULAR WEIGHT HYDROCARBON | |
|---|---|
| Molecular Weight Distribution Peak | 630 |
| Viscosity Cst. 37.8° C. | 550 |
| 100° C. | 25 |
| Viscosity Index | 95 |
| Pour Point, ASTM D97 | −5° C. |
| Fire Point COC, ASTM D92 | 344° C. |
| Flash Point COC, ASTM D92 | 293° C. |
| Gravity. API 15.6° C. | 26.4 |
| Carbon content % | 0.7 |
| Sulfur content % | 0.25 |
| Color, ASTM D1500 | 6 |
| Paraffinic | 70% |
| Naphthenic | 28% |
| Aromatic | 2% |
| **LOW MOLECULAR WEIGHT HYDROCARBON** | |
| Molecular Weight Distribution Peak | 480 |
| Viscosity Cst. 37.8° C. | 100 |
| 100° C. | 13 |
| Pour Point, ASTM D97 | −14° C. |
| Flash Point COC, ASTM D92 | 246° C. |
| Fire Point COC, ASTM D92 | 270° C. |
| Gravity API 15.6° C. | 28.7 |
| Neutralization # | 0.01 |
| Carbon content % | 0.03 |
| Sulfur content % | 0.016 |
| Color, ASTM D1500 | L-3 |
| Paraffinic | 73% |
| Naphthenic | 8% |
| Aromatic | 19% |
| **POLYALPHAOLEFIN** | |
| Molecular Weight Distribution Peak | 580 |
| Viscosity Cst. 37.8° C. | 117.3 |
| 100° C. | 13.05 |
| Viscosity Index, ASTM D2246 | 115 |
| Pour Point ASTM, D97 | −48° C. |
| Flash Point ASTM, D92 | 299° C. |
| Fire Point ASTM, D92 | 321° C. |
| Neutralization Number, ASTM D974 | 0.026 |
| Specific Gravity, 60° F. | 0.8604 |

After blending the physical and electrical properties of the dielectric composition were as follows:

| DIELECTRIC COMPOSITION | |
|---|---|
| Molecular Weight Distribution Peak | 550 |
| Viscosity, CST. 40° C. | 163.0 |
| 100° C. | 17.4 |
| Pour Point, ASTM D97 | −20° C. |
| Flash Point COC, ASTM D92 | 265° C. |
| Fire Point COC, ASTM D92 | 305° C. |
| Neutralization Number, mg KOH/g | 0.041 |
| Dielectric Constant | 2.23 |
| Volume Resistivity, ohm-cm | $1.4 \times 10^{14}$ |
| Power Factor, %, 23° C. | 0.043 |
| 100° C. | 0.489 |

With the addition of 1.5% of a conventional styrene-base pour point depressant, the pour point of the above fluid was −30° C.

EXAMPLE II

A liquid dielectric composition was prepared by mixing 65% by weight of a high molecular hydrocarbon, having the properties as set forth in Example I, 15% by weight of a low molecular weight hydrocarbon having the properties as set forth in Example I, and 20% of polyalphaolefin. The polyalphaolefin was derived from olefin monomers containing 10 to 12 carbon atoms and had the following physical properties.

| POLYALPHAOLEFIN | |
|---|---|
| Molecular Weight Distribution Peak | 540 |

-continued

| POLYALPHAOLEFIN | |
|---|---|
| Viscosity, Centistokes 40° C. | 100 |
| 100° C. | 14 |
| Viscosity Index | 130 |
| Flash Point COC, ASTM D92 | 291° C. |
| Fire Point COC, ASTM D92 | 307° C. |
| Pour Point, ASTM D97 | −48° C. |
| Specific Gravity at 20° C. | 0.837 |

The resulting mixture had the following physical and electrical properties:

| DIELECTRIC COMPOSITION | |
|---|---|
| Molecular Weight Distribution Peak | 560 |
| Viscosity, Centistokes 40° C. | 259 |
| 100° C. | 23 |
| Pour Point, ASTM D97 | −23° C. |
| Flash Point COC, ASTM D92 | 274° C. |
| Fire Point COC, ASTM D92 | 304° C. |
| Dielectric Constant 23° C. | 2.35 |
| Power Factor, %, 23° C. | 0.03 |
| 100° C. | 0.26 |
| Volume Resistivity, ohm-cm | $2.4 \times 10^{14}$ |
| Dielectric Breakdown, ASTM D877 | 40 kv |

EXAMPLE III

A dielectric liquid composition was prepared by mixing 90% by weight of a high molecular weight, hydrocarbon oil, and 10% by weight of a polyalphaolefin. The physical properties of the components were as follows:

| HYDROCARBON OIL | |
|---|---|
| Molecular Weight Distribution Peak | 530 |
| Viscosity Cst. 37.8° C. | 550 |
| 100° C. | 25 |
| Viscosity Index | 95 |
| Pour Point, ASTM D97 | −5° C. |
| Fire Pioint COC, ASTM D92 | 344° C. |
| Flash Point COC, ASTM D92 | 293° C. |
| Gravity. API 15.6° C. | 26.4 |
| Carbon content % | 0.7 |
| Sulfur content % | 0.25 |
| Color, ASTM D1500 | 6 |
| Paraffinic | 70% |
| Naphthenic | 28% |
| Aromatic | 2% |
| **POLYALPHAOLEFIN** | |
| Molecular Weight Distribution Peak | |
| Viscosity Cst. 38.0° C. | 18.0 |
| 98.9° C. | 3.9 |
| Viscosity Index, ASTM D2246 | 121 |
| Pour Point ASTM, D97 | −73° C. |
| Flash Point ASTM, D92 | 216° C. |
| Fire Point ASTM, D92 | 250° C. |
| Total Acid Number, ASTM D974 | 0.02 |
| Specific Gravity, 60° F. | 0.8190 |

After blending the physical and electrical properties of the dielectric composition were as follows:

| DIELECTRIC COMPOSITION | |
|---|---|
| Molecular Weight Distribution Peak | |
| Pour Point, ASTM D97 | −20° C. |
| Flash Point COC, ASTM D92 | 262° C. |
| Fire Point COC, ASTM D92 | 300° C. |
| Dielectric Constant | 2.23 |
| Volume Resistivity, ohm-cm | $3.2 \times 10^{14}$ |
| % Dissipation | 0.03% |

EXAMPLE IV

A dielectric liquid composition was prepared by mixing 70% by weight of a high molecular weight, hydrocarbon oil, and 30% by weight of a polyalphaolefin. The physical properties of the components were as follows:

| HYDROCARBON OIL | |
|---|---|
| Molecular Weight Distribution Peak | 530 |
| Viscosity Cst. 37.8° C. | 550 |
| 100° C. | 25 |
| Viscosity Index | 95 |
| Pour Point, ASTM D97 | −5° C. |
| Fire Point COC, ASTM D92 | 344° C. |
| Flash Point COC, ASTM D92 | 293° C. |
| Gravity. API 15.6° C. | 26.4 |
| Carbon content % | 0.7 |
| Sulfur content % | 0.25 |
| Color, ASTM D1500 | 6 |
| Paraffinic | 70% |
| Naphthenic | 28% |
| Aromatic | 2% |
| **POLYALPHAOLEFIN** | |
| Molecular Weight Distribution Peak | |
| Viscosity Cst. 38.0° C. | 50.9 |
| 98.9° C. | 8.0 |
| Viscosity Index, ASTM D2246 | 138 |
| Pour Point ASTM, D97 | −57° C. |
| Flash Point ASTM, D92 | 257° C. |
| Fire Point ASTM, D92 | 290° C. |
| Total Acid Number, ASTM D974 | 0.03 |
| Specific Gravity, 60° F. | 0.8320 |

After blending the physical and electrical properties of the dielectric composition were as follows:

| DIELECTRIC COMPOSITION | |
|---|---|
| Molecular Weight Distribution Peak | |
| Pour Point, ASTM D97 | −21° C. |
| Flash Point COC, ASTM D92 | 262° C. |
| Fire Point COC, ASTM D92 | 301° C. |
| Dielectric Constant | 2.22 |
| Volume Resistivity, ohm-cm | $3.0 \times 10^{14}$ |
| % Dissipation | 0.03% |

Various modes of carrying out the invention are contemplated as being within the scope of the following claims particularly pointing out and distinctly claiming the subject matter which is regarded as the invention.

We claim:

1. An electrical apparatus for use in high fire point applications, comprising an outer casing, a pair of electrical conductors disposed within the casing, a dielectric material separating the conductors, and a liquid dielectric composition impregnating said dielectric material and comprising from 1% to 25% by weight of a low molecular weight hydrocarbon oil having a molecular weight distribution peak in the range of 460 to 510, 40% to 80% by weight of a high molecular weight hydrocarbon oil having a molecular weight distribution peak in the range of 600 to 720, and the balance being a polyalphaolefin, said polyalphaolefin having from 8 to 12 carbon atoms in the olefin monomer and having a molecular weight distribution peak in the range of 320 to 600, said liquid dielectric composition having a fire point above 300° C. and a pour point at least as low as −20° C.

2. The electrical apparatus of claim 1, wherein said low molecular hydrocarbon oil has a fire point in the range of 260° C. to 280° C., said high molecular weight hydrocabon oil has a fire point in the range of 325° C. to 355° C., and said polyalphaolefin has a fire point in the range of 300° C. to 325° C.

3. The electric apparatus of claim 1, wherein said hydrocarbon oils are selected from the group consisting of paraffinic based oils and naphthenic based oils.

4. The electrical apparatus of claim 1, wherein said apparatus comprises a transformer.

5. The electrical apparatus of claim 2, wherein said high molecular weight hydrocarbon oil has a pour point in the range of 0° C. to −10° C., said low molecular weight hydrocarbon oil has a pour point in the range of −10° C. to −18° C., and said polyalphaolefin has a pour point in the range of −40° C. to −56° C.

6. The electrical apparatus of claim 1, wherein said composition includes from 5% to 15% by weight of said low molecular weight hydrocarbon oil, from 60% to 70% by weight of said high molecular weight hydrocarbon oil, and the balance being said polyalphaolefin.

7. An electrical apparatus for use in high fire point applications, comprising an outer casing, a pair of electrical conductors disposed within the casing, a dielectric material separating the conductors, and a liquid dielectric composition impregnating said dielectric material and comprising a mixture of from 1% to 25% by weight of a low molecular weight hydrocarbon oil having a molecular weight distribution peak in the range of 460 to 510 and having a fire point in the range of 260° C. to 280° C. and a pour point in the range of −10° C. to −18° C., 40% to 80% by weight of a high molecular weight hydrocarbon oil having a molecular weight distribution peak in the range of 600 to 720 and having a fire point in the range of 325° C. to 335° C. and a pour point in the range of 0° C. to −10° C., and the balance being a polyalphaolefin, said polyalphaolefin having from 8 to 12 carbon atoms in the olefin monomer and having a molecular weight distribution peak in the range of 320 to 600 and having a fire point in the range of 300° C. to 325° C. and a pour point in the range of −40° C. to −56° C., said liquid dielectric composition having a fire point above 300° C. and a pour point at least as low as −20° C.

* * * * *

UNITED STATES PATENT AND TRADEMARK OFFICE

CERTIFICATE OF CORRECTION

PATENT NO. : 4,530,782

DATED : July 23, 1985

INVENTOR(S) : WILLIAM R. MEYER

It is certified that error appears in the above-identified patent and that said Letters Patent is hereby corrected as shown below:

Col. 3, line 48, Cancel "335°C" and substitute therefor ---355°C---; Col. 8, line 12, CLAIM 7, Cancel "335°C" and substitute therefor ---355°C---.

Signed and Sealed this

*Twenty-second* Day of *October 1985*

[SEAL]

*Attest:*

*Attesting Officer*

DONALD J. QUIGG

*Commissioner of Patents and Trademarks—Designate*